United States Patent [19]

Popma

[11] 4,202,544

[45] May 13, 1980

[54] TENNIS SCOREKEEPING DEVICE AND METHOD OF USING

[76] Inventor: Jewett E. Popma, 100 SW Leonard St., Lake Oswego, Oreg. 97034

[21] Appl. No.: 852,796

[22] Filed: Nov. 18, 1977

[51] Int. Cl.[2] ..... A63B 49/00

[52] U.S. Cl. ..... 273/73 R

[58] Field of Search ..... 273/73 R, 162 R, 162 A, 273/183 R, 183 D; 40/19, 21 R, 28 R, 316, 317, 23 R, 23 A; 116/130, 133, 222, 223, 312, 317; 211/59.1; 248/220.3

[56] References Cited

U.S. PATENT DOCUMENTS

| | | | |
|---|---|---|---|
| 434,425 | 8/1890 | Cooper | 273/73 R X |
| 448,878 | 3/1891 | Clarke | 273/73 R |
| 1,811,660 | 6/1931 | Bausher | 40/21 R |
| 2,167,465 | 7/1939 | Sell | 116/130 X |
| 2,211,635 | 8/1940 | Barteaux | 273/162 A X |
| 2,492,592 | 12/1949 | Perry et al. | 116/130 X |
| 3,212,207 | 10/1965 | Searing | 40/316 |
| 3,460,508 | 8/1969 | Baxter | 116/133 |
| 3,787,993 | 1/1974 | Lyon | 40/28 R X |
| 3,986,715 | 10/1976 | Glick | 273/73 R |

FOREIGN PATENT DOCUMENTS

| | | | |
|---|---|---|---|
| 14349 | of 1885 | United Kingdom | 273/73 J |
| 19853 | of 1898 | United Kingdom | 273/73 R |
| 333825 | 8/1930 | United Kingdom | 116/223 |
| 336169 | 10/1930 | United Kingdom | 116/223 |

*Primary Examiner*—Richard J. Apley
*Attorney, Agent, or Firm*—Francis Swanson

[57] ABSTRACT

A device for keeping score of tennis games and sets is disclosed. The invention comprises a series of bands which slip onto the throat of the tennis racquet above the grip. In the present embodiment the bands are elastic. On the bands are symbols indicating the relation of games and sets. The bands are color coded to indicate opponents. For convenience, a reference dot is mounted on the racquet. Rotation of the respective bands relative to the reference dot shows the status of games and/or sets.

2 Claims, 5 Drawing Figures

FIG. 1
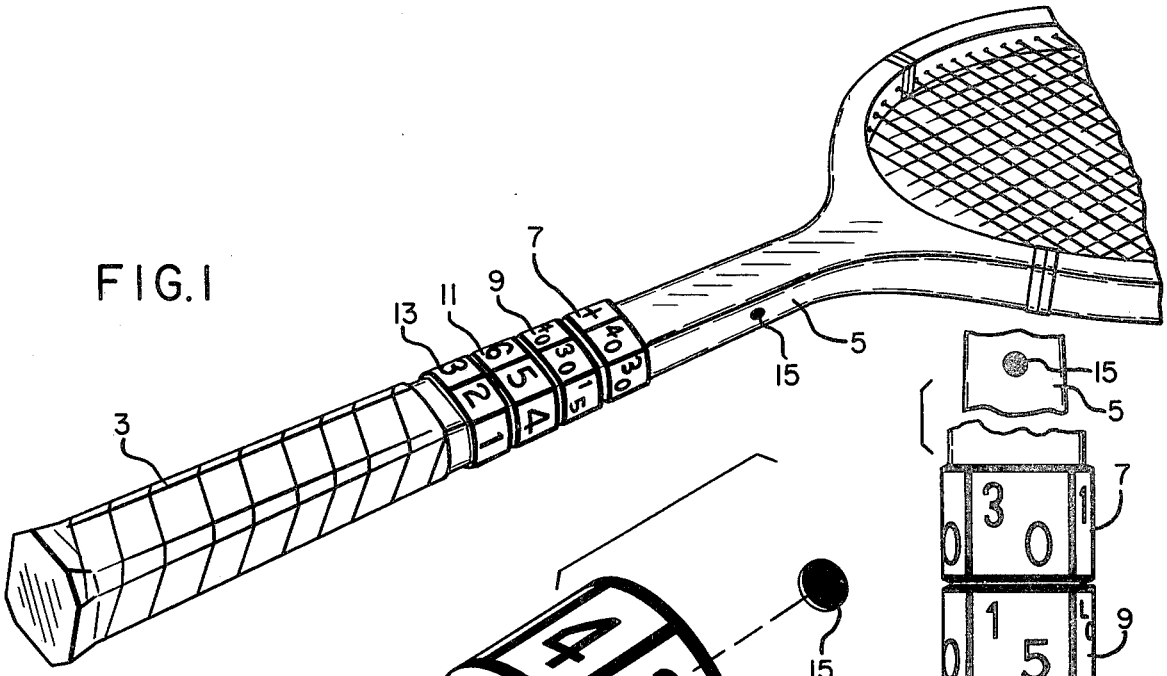
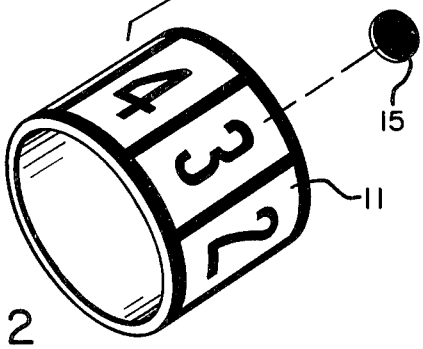
FIG. 2
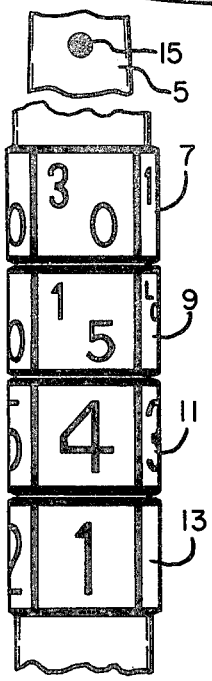
FIG. 3
FIG. 4
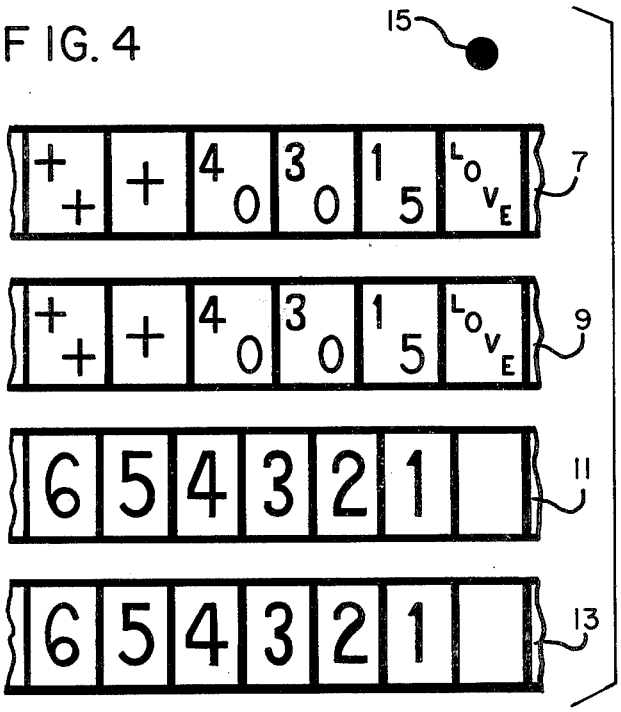
FIG. 5
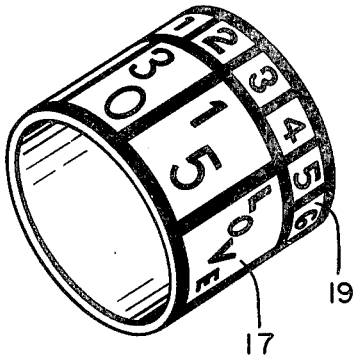

TENNIS SCOREKEEPING DEVICE AND METHOD OF USING

BACKGROUND OF THE INVENTION

1. Field of the Invention

The invention pertains to tennis scorekeeping devices in general and more particularly to those mounted on racquets and employing elastic bands.

2. Description of the Prior Art

Numerous scorekeeping devices for games exist in the prior art. However, few are known for tennis. An example of one used for golf is illustrated in U.S. Pat. No. 448,878 to Clarks.

Various mechanical counters which bolt onto the handle of a playing racquet or club are known. These devices are generally cumbersome and susceptible to breaking if struck by a ball. They are relatively heavy and awkward to use. Others require regular maintenance to keep functioning.

SUMMARY OF THE INVENTION

It is a principal object of the invention to provide simple reliable means of keeping both the game score and the set score of a tennis match as it progresses.

A further object of the invention is to provide a scorekeeping device using movable bands which slip onto the playing instrument such as a racquet. In the preferred embodiment the bands are elastic and mount on the throat of the racquet.

A further object of the invention is to provide an inexpensive lightweight maintenance-free scorekeeping device which is easily mounted or removed from the playing instrument without substantial modification thereof.

Other objects and advantages of the invention will be apparent to those skilled in the art with reference to the accompanying drawings and specifications.

BRIEF DESCRIPTION OF THE DRAWINGS

FIG. 1 is a perspective view showing the invention mounted on the throat of a tennis racquet.

FIG. 2 shows a game counter band and its relation to a reference dot.

FIG. 3 is a plan view of the invention on the throat of a racquet showing the game score 30 to 15 and the set score 3 to 1.

FIG. 4 shows the bands broken away to illustrate the numerals and letters thereon.

FIG. 5 is an illustration of a combination band which may be used for tennis or golf.

DETAILED DESCRIPTION

FIG. 1 shows the invention on a tennis racquet (1) which has a handle (3) and throat (5). In the preferred embodiment the invention comprises four expandable elastic bands (7), (9), (11), and (13) which are slipped over handle (3) and onto an elongate throat (5) defined by racquet (1). Being elastic and almost weightless, the bands readily stretch to slip over the butt of the racquet (1). Compression of the bands on the throat (5) holds them in place. A reference dot (15) is mounted on the shank (5). It will be readily apparent to those skilled in the art that the bands may be made of a wide variety of materials and could be incorporated into the original construction of the racquet (1) as a permanent feature. Likewise the dot (15) is merely a convenience. Any reference would serve. For example, the edge of throat

(5) could be used to orient the bands. For easy reading, bands (7), (9), (11), and (13) are color coded to indicate opponents. For example, game band (7) and set band (11) are red while game band (9) and set band (13) are blue. The bands have appropriate markings on them for indicating scores. As shown, game bands (7) and (9) have printed in successive squares numerals 15, 30 and 40, as well as the word LOVE and a single (+) and a double (+ +). On set bands (11) and (13) are printed in successive squares the numbers 1 through 6. One square is solid color to indicate no games. Appropriate markings to indicate scoring of other games could readily be incorporated thereon. For example, FIG. 5 illustrates a combination band having numerals (17) for tennis and numerals (19) for golf.

USE OF THE INVENTION

In the illustrated embodiment, reference dot (15) is mounted on throat (5). Bands (7), (9), (11) and (13) are then placed around handle (3) onto throat (5) below dot (15) and lined up to indicate no score or sets. When a point is scored that player's band is rotated so that his score is indicated directly below the reference dot (15). As the game progresses, rotation of the respective opponent's band relative to the dot (15) will always indicate the score. When the score stands at double deuce, indicated by (+ +), and a point is scored, the losing player's band is rotated to indicate single (+).

Set bands are similarly used. When play is begun the bands (11) and (13) are aligned with the solid color squares under dot (15). After a game is won and game bands (7) and (9) set to the beginning position, the winning player's set band is rotated to indicate his winning of that game. As games and sets progress the bands are continuously rotated to keep the proper score. The player thus always has the score readily before him on the racquet. Bands (11) and (13) could also be used merely to indicate the total number of games played.

Having disclosed my invention and described it in detail, it will be apparent that many modifications could be made without departing from the true spirit and scope of the invention. For example, it is readily apparent that, with minor changes, the invention could be adapted to keep golf, badminton, or squash scores. The invention is not limited to colored elastic bands but may be constructed of any convenient material and without color. The invention could be constructed as a permanent part of a new racquet. A plurality of markings suitable for several games could be incorporated on the bands. The bands could even be worn on the wrist of a handball player for keeping score. I claim as my invention all such modifications as fall within the scope and equivalence of the appended claims.

I claim:

1. In combination, a game playing instrument having an elongate handle and a game score indicator on the handle wherein the improvement comprises:

a plurality of separate player identifying stretchable bands, at least partly elastic, and removeably mounted by compression of the elastic on the instrument's handle;

the bands including means for indicating scores of at least two separate players simultaneously;

reference means on the playing instrument for aligning the bands therewith to indicate the score of the game;

and separate means on the handle for indicating the games won and lost by each player.

2. The method of keeping the game score of two players on the throat of a playing instrument having thereon a plurality of expansable and compressible elastic bands, each of the bands having thereon a plurality of score indicators including an indicator for the score zero, and a band reference indicator fixed to the playing instrument, comprising the steps of:

(A) slipping the bands over the throat of the playing instrument;

(B) aligning the zero indicator on each of the bands on the throat with the band reference indicator;

(C) expanding the band after a score is made;

(D) rotating the band relative to the band reference indicator;

(E) aligning a score indicator on the rotating band with a score indicator on the non-rotating band simultaneous with alignment of the score indicator on the rotated band with the band reference indicator;

(F) compressing the rotated band on the throat.

* * * * *